US011776512B2

(12) United States Patent
Kasubuchi et al.

(10) Patent No.: US 11,776,512 B2
(45) Date of Patent: Oct. 3, 2023

(54) KEYBOARD DEVICE

(71) Applicant: Roland Corporation, Shizuoka (JP)

(72) Inventors: Masaki Kasubuchi, Shizuoka (JP); Hitoshi Sato, Shizuoka (JP); Yukihide Takata, Shizuoka (JP); Mutsuo Sawada, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 17/785,397

(22) PCT Filed: Dec. 18, 2019

(86) PCT No.: PCT/JP2019/049592

§ 371 (c)(1),
(2) Date: Jun. 14, 2022

(87) PCT Pub. No.: WO2021/124477

PCT Pub. Date: Jun. 24, 2021

(65) Prior Publication Data

US 2023/0029113 A1 Jan. 26, 2023

(51) Int. Cl.
*G10C 3/16* (2019.01)
*G10C 3/12* (2006.01)

(52) U.S. Cl.
CPC ..... *G10C 3/16* (2013.01); *G10C 3/12* (2013.01)

(58) Field of Classification Search
CPC ..... G10C 3/16; G10C 3/12
See application file for complete search history.

(56) References Cited

U.S. PATENT DOCUMENTS 1,246,998 A * 11/1917 Pickard et al. ..... G10C 3/12 84/435
4,217,803 A * 8/1980 Dodds ..... G10H 1/346 84/439

(Continued)

FOREIGN PATENT DOCUMENTS

JP 2019053107 4/2019
JP 2019056743 4/2019

(Continued)

OTHER PUBLICATIONS

"Written Opinion of the International Searching Authority (Form PCT/ISA/237) of PCT/JP2019/049592," dated Mar. 10, 2020, with English translation thereof, pp. 1-6.

(Continued)

*Primary Examiner* — Robert W Horn
(74) *Attorney, Agent, or Firm* — JCIPRNET

(57) ABSTRACT

Provided is a keyboard device for which the number of parts can be reduced. The present invention is provided with: hammers rotatably linked to a chassis; keys rotatably linked to the hammer thereof; guiding pins provided to the keys and extending in the widthwise direction of the keys; and a guiding groove provided to the chassis side and into which the guiding pins are inserted. The downward displacement of the front-end sides of the keys is guided by the rotation of the hammers with respect to the chassis, and the downward displacement of rear-end parts of the keys is guided by the sliding of the guiding pins with respect to the guiding groove. This eliminates the need for links to guide the displacement of the rear-end parts of the keys, thus allowing the number of parts to be reduced.

20 Claims, 7 Drawing Sheets

(56) References Cited

U.S. PATENT DOCUMENTS

| | | | | | |
|---|---|---|---|---|---|
| 4,846,041 | A * | 7/1989 | Kumano | G10C 3/12 | 984/61 |
| 5,090,290 | A * | 2/1992 | Kumano | G10C 3/12 | 84/434 |
| 5,406,875 | A * | 4/1995 | Tamai | G10H 1/344 | 84/719 |
| 5,542,332 | A * | 8/1996 | Tamai | G10H 1/344 | 84/719 |
| 5,610,352 | A * | 3/1997 | Yamaguchi | G10C 3/12 | 84/251 |
| 5,824,928 | A * | 10/1998 | Kumano | G10C 3/12 | 84/440 |
| 5,959,228 | A * | 9/1999 | Yamaguchi | G10C 3/12 | 84/433 |
| 7,208,668 | B2 * | 4/2007 | Shimoda | G10C 3/12 | 84/434 |
| 7,750,222 | B2 * | 7/2010 | Osuga | G10C 3/12 | 84/719 |
| 8,110,732 | B2 * | 2/2012 | Shimoda | G10C 3/12 | 84/423 R |
| 8,921,676 | B2 * | 12/2014 | Iwase | G10H 1/346 | 84/433 |
| 9,006,549 | B2 * | 4/2015 | Suzuki | G10C 3/18 | 84/423 R |
| 9,082,372 | B2 * | 7/2015 | Suzuki | G10C 3/12 | |
| 9,495,940 | B2 * | 11/2016 | Hoshino | G10C 3/12 | |
| 10,373,596 | B2 * | 8/2019 | Suzuki | G10H 1/346 | |
| 11,508,341 | B2 * | 11/2022 | Suzuki | G10H 1/344 | |
| 2021/0295808 | A1 * | 9/2021 | Nishimura | G10H 1/346 | |
| 2023/0029113 | A1 * | 1/2023 | Kasubuchi | G10C 1/00 | |

FOREIGN PATENT DOCUMENTS

| | | |
|---|---|---|
| JP | 2019056781 | 4/2019 |
| JP | 2019061113 | 4/2019 |

OTHER PUBLICATIONS

"International Search Report (Form PCT/ISA/210) of PCT/JP2019/049592," dated Mar. 10, 2020, with English translation thereof, pp. 1-4.

"Office Action of Japan Counterpart Application", dated Mar. 14, 2023, with English translation thereof, p. 1-p. 7.

* cited by examiner (a)

(b)

(a)

(b)

(a)

(b)

(a)

(b)

(a)

(b)

KEYBOARD DEVICE

CROSS-REFERENCE TO RELATED APPLICATION

This application is a 371 application of the International PCT application serial no. PCT/JP2019/049592, filed on Dec. 18, 2019. The entirety of each of the above-mentioned patent applications is hereby incorporated by reference herein and made a part of this specification.

TECHNICAL FIELD

The disclosure relates to a keyboard device, and more particularly to a keyboard device for which the number of parts can be reduced.

RELATED ART

The rotation center of the key of an acoustic piano is located on the rear side relatively far from the front end (player side) of the key; therefore, when the key of the acoustic piano is pressed, the entire key (area where the key can be pressed) is displaced to sink downward by a predetermined amount. In this regard, Patent Literature 1 discloses a technique for rotatably connecting a front link bar 6 and a rear link bar 7 that are rotatable with respect to a base 2 to a front end side and a rear end side of a key 3, respectively. According to this technique, the rotation of the front link bar 6 and the rear link bar 7 when the key 3 is pressed can cause the front end side and the rear end side of the key 3 (the entire key 3) to be displaced downward.

CITATION LIST

Patent Literature

[Patent Literature 1] Japanese Patent Lain-Open No. 2019-056781 (for example, FIG. 2)

SUMMARY

Technical Problem

However, in the above-mentioned conventional technique, since the displacement of the rear end part of the key is guided by the rotation of the link, there is a problem that the number of links (that is, the number of part) increases.

The disclosure has been in view of the above, and the disclosure provides a keyboard device for which the number of parts can be reduced.

Solution to Problem

In order to achieve the above, a keyboard device of the disclosure includes: a support member; a link with one end side rotatably connected to the support member; a key rotatably connected to an other end side of the link; a guiding pin which is provided on one of a part on a rear end side of the key and a support member side and which extends in a width direction of the key; and a guiding groove which is provided on the other of the part on the rear end side of the key and the support member side and into which the guiding pin is inserted. A displacement of a part on a front end side of the key is guided by rotation of the link with respect to the support member, and a displacement of the part on the rear end side of the key is guided by sliding of the guiding pin with respect to the guiding groove.

DESCRIPTION OF THE EMBODIMENTS

Figure 1:
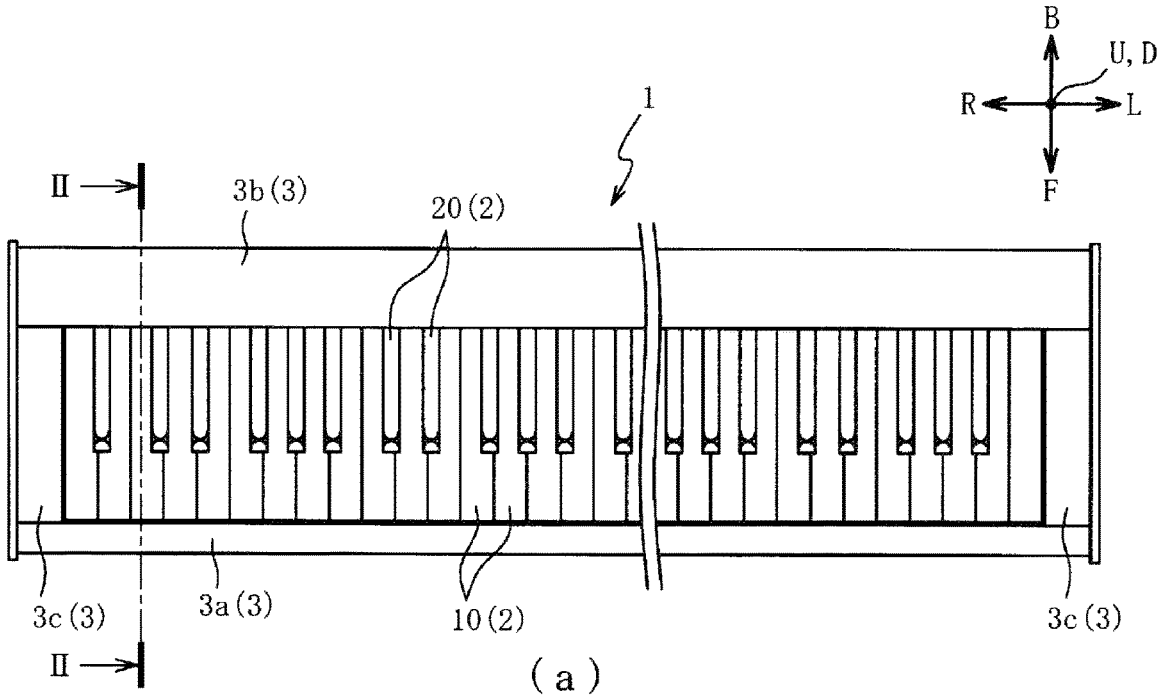
In FIG. 1, (a) is a top view of the keyboard device according to the first embodiment, and (b) is a perspective view of the keyboard device.
Figure 1:
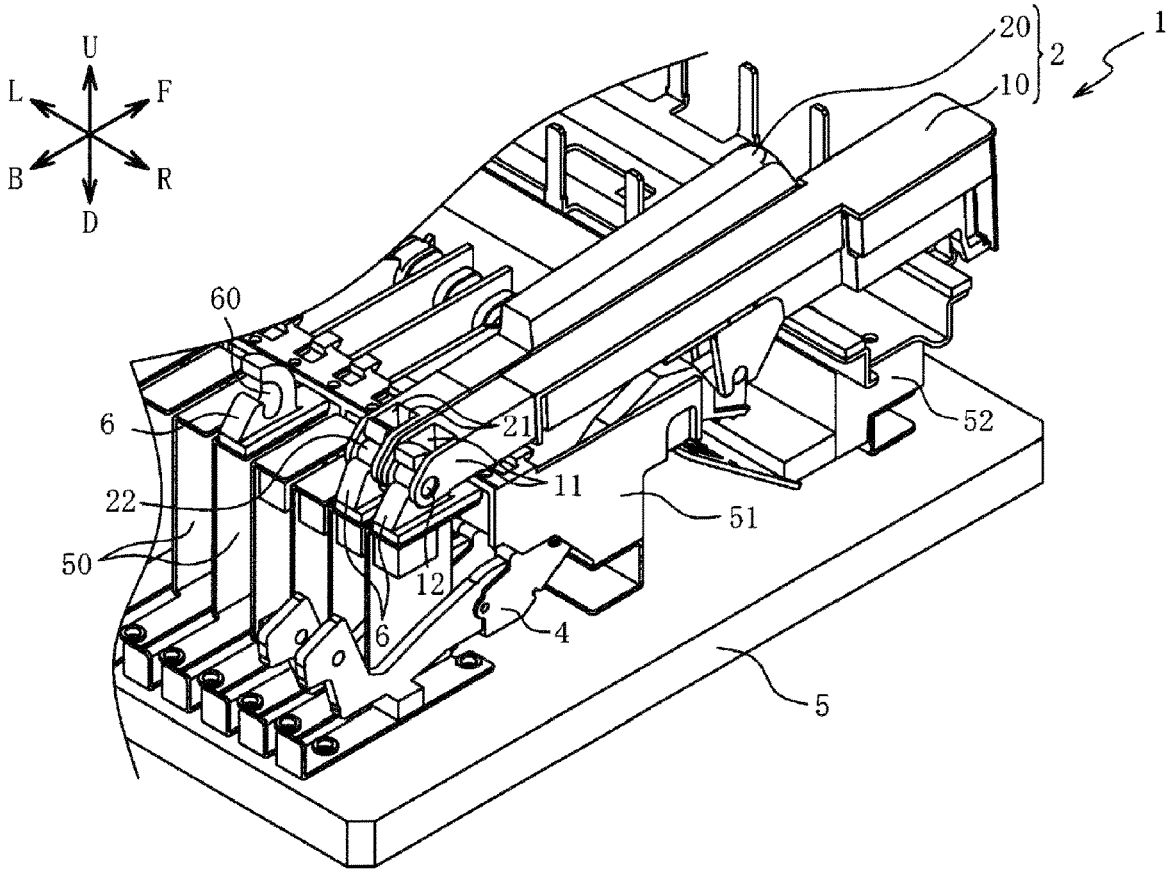

Hereinafter, exemplary embodiments will be described with reference to the accompanying drawings. First, with reference to FIG. 1, the overall configuration of a keyboard device 1 will be described. In FIG. 1, (a) is a top view of the keyboard device 1 according to the first embodiment, and (b) is a perspective view of the keyboard device 1.

In (b) of FIG. 1, a part of the keyboard device 1 (for example, a part of multiple keys 2 and a panel 3) is not shown. Further, the arrows U-D direction, F-B direction, and L-R direction in FIG. 1 indicate the up-down direction, the front-rear direction, and the left-right direction of the keyboard device 1, respectively, and the same applies to the subsequent drawings.

As shown in (a) of FIG. 1, the keyboard device 1 is configured as a keyboard instrument (electronic piano) including multiple (88 in this embodiment) keys 2, and a panel 3 surrounding the multiple keys 2. The key 2 includes multiple (52 in this embodiment) white keys 10 for playing a trunk sound, and multiple (36 in this embodiment) black keys 20 for playing a derivative sound. The multiple white keys 10 and black keys 20 are provided side by side in the left-right direction (arrow L-R direction).

The panel 3 includes a front panel 3*a*, a back panel 3*b* disposed to face the front panel 3*a* in the front-rear direction (arrow F-B direction), and a pair of end panels 3*c* connecting the left and right ends of the front panel 3*a* and the back panel 3*b*. The white keys 10 and the black keys 20 are surrounded by the front panel 3*a*, the back panel 3*b*, and the pair of end panels 3*c*.

On the upper surface of the back panel 3*b*, for example, a display device formed of an LED, a liquid crystal display, or the like for displaying various states, and multiple operators for adjusting the volume, changing modes, and the like are provided (none of them are shown). Further, on the back surface of the back panel 3*b*, for example, a power switch, multiple jacks for inputting and outputting MIDI signals and audio signals, and the like are provided (none of them are shown).

As shown in (b) of FIG. 1, the keyboard device 1 is provided with a plate-shaped chassis 5 extending in the left-right direction (arrow L-R direction) for supporting the keys 2, hammers 4, and the like. A rear base 50 supporting the rear end of the key 2 (the end on the arrow B side), a central base 51 supporting the hammer 4, and a front base 52 guiding the displacement of the front end of the key 2 (the end on the arrow F side) are fixed on the upper surface (the surface on the arrow U side) of the chassis 5.

A guiding member 6 is fixed on the upper surface of the rear base 50, and the guiding member 6 includes a guiding groove 60 for sliding displacement of the rear end part of the key 2. The guiding groove 60 is a groove formed to pass through the guiding member 6 in the left-right direction. The white key 10 and the black key 20 include a pair of left and right support plates 11 and 21 protruding rearward from the rear ends thereof, and guiding pins 12 and 22 in a columnar shape that cross to the left and right between the pair of support plates 11 and 21.

The groove width of the guiding groove 60 (dimension in the direction orthogonal to the sliding direction of the guiding pins 12 and 22) is formed to be equal to or slightly less than the diameter of the guiding pins 12 and 22, and the guiding pins 12 and 22 are slidably inserted into the guiding groove 60. Therefore, the displacement on the rear end side of the white key 10 and the black key 20 is guided by the sliding of the guiding pins 12 and 22 along the guiding groove 60. In addition, the displacement of the white key 10 and the black key 20 on the front side of the guiding pins 12 and 22 is guided by the rotation of the hammer 4.

In this embodiment, each base of the chassis 5 (the rear base 50, the central base 51, and the front base 52) and the guiding member 6 configure a support member for supporting the key 2 and the hammer 4, and a part or all of each base of the chassis 5 and the guiding member 6 may be integrally formed (as one component) to configure the support member.

Figure 2:
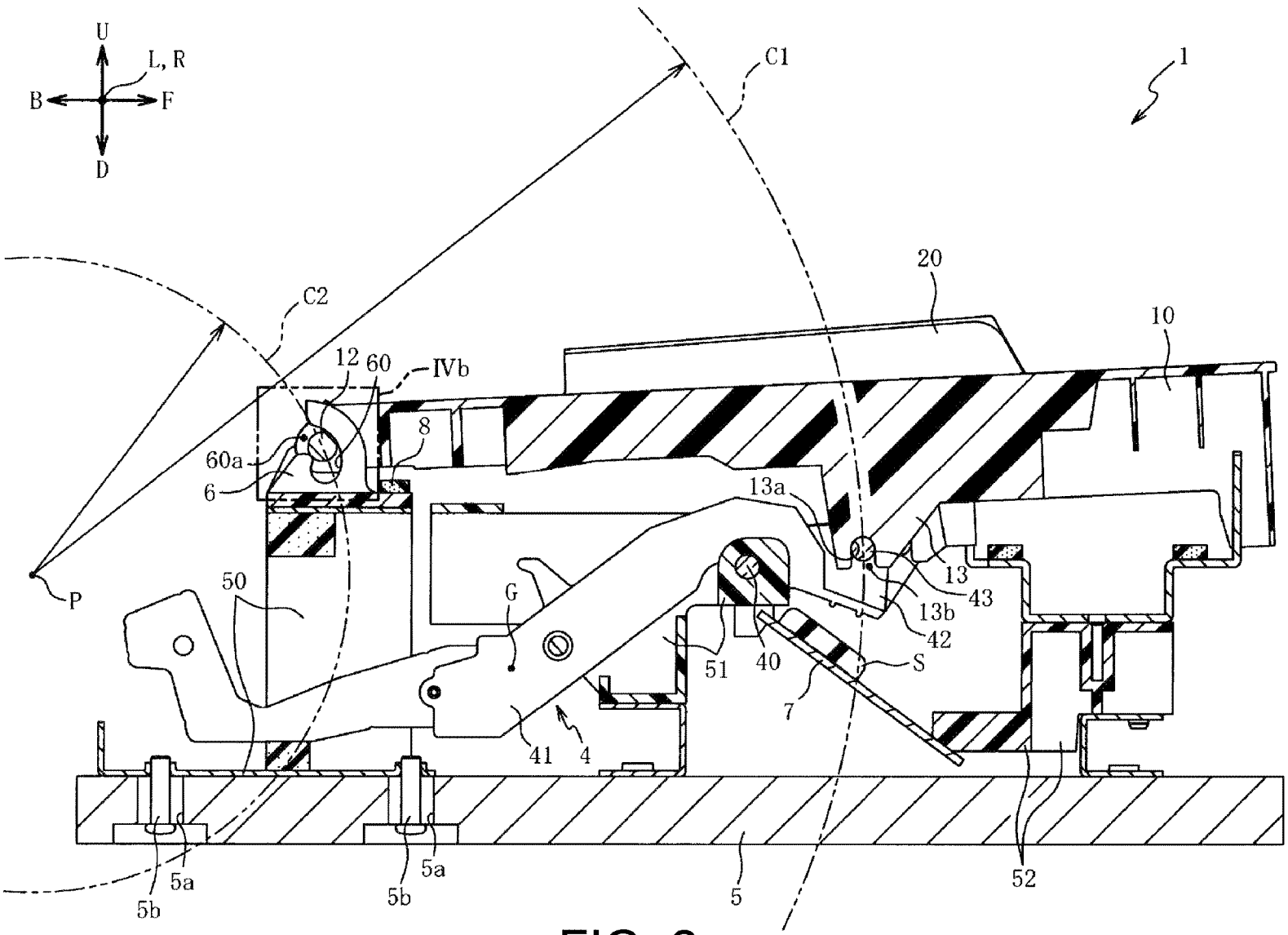
FIG. 2 is a cross-sectional view of the keyboard device taken along the line II-II in (a) of FIG. 1.
Figure 3:
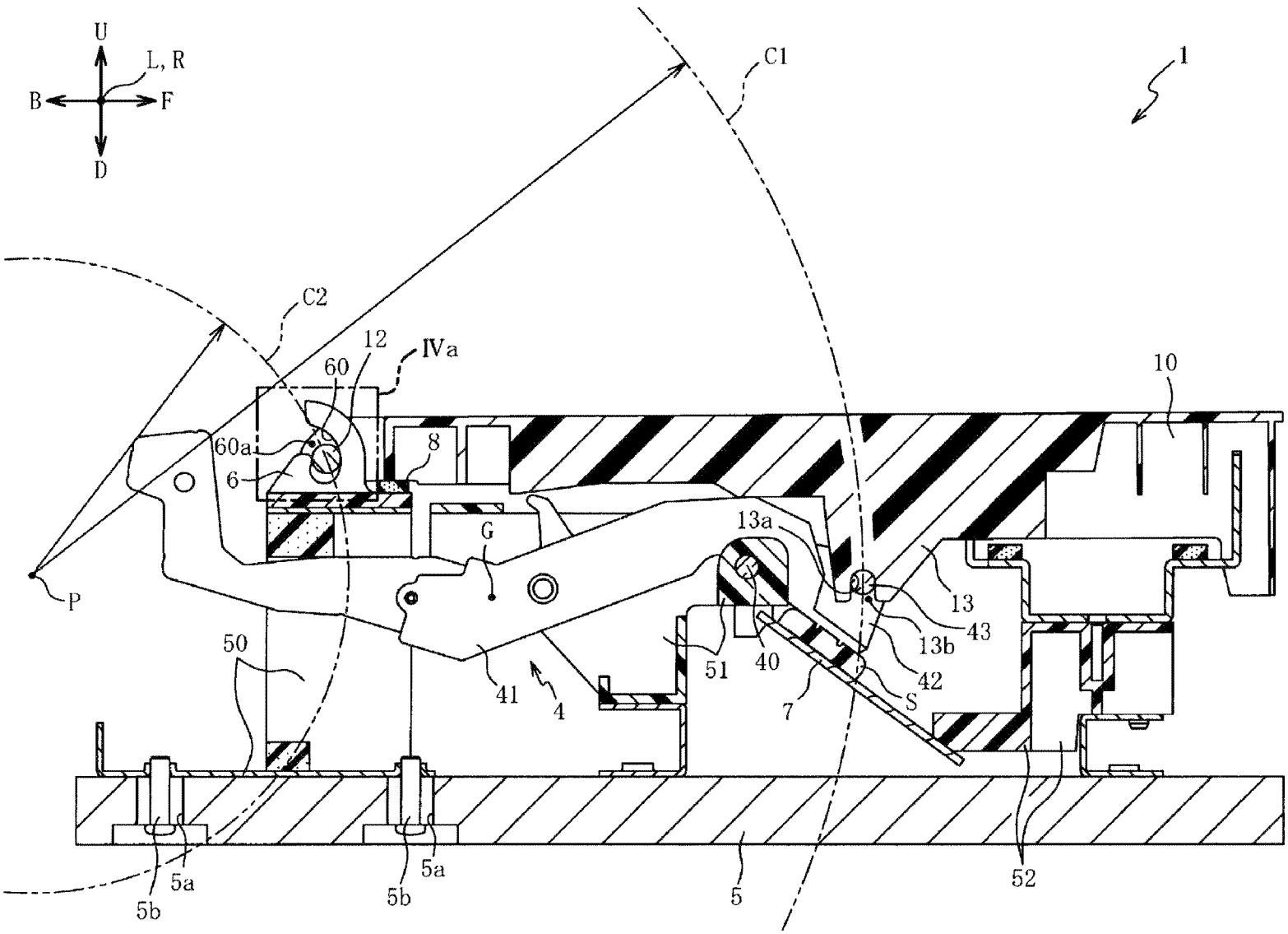
FIG. 3 is a cross-sectional view of the keyboard device showing a state in which the white key is pressed from the state of FIG. 2.
Figure 4:
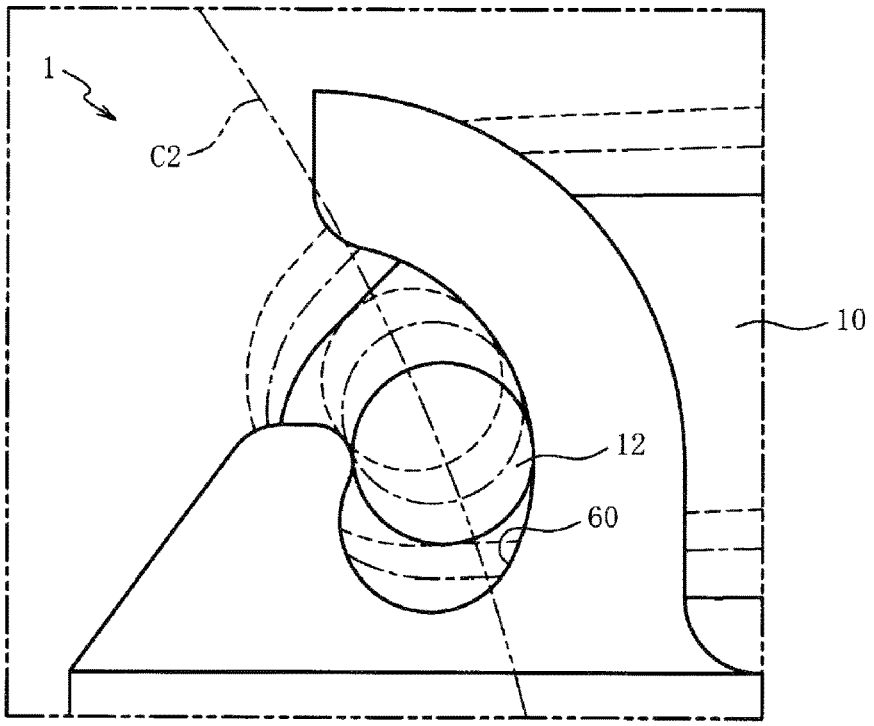
In FIG. 4, (a) is a partially enlarged cross-sectional view of the keyboard device in which the IVa part of FIG. 3 is enlarged, and (b) is a partially enlarged cross-sectional view of the keyboard device in which the IVb part of FIG. 2 is enlarged.
Figure 4:
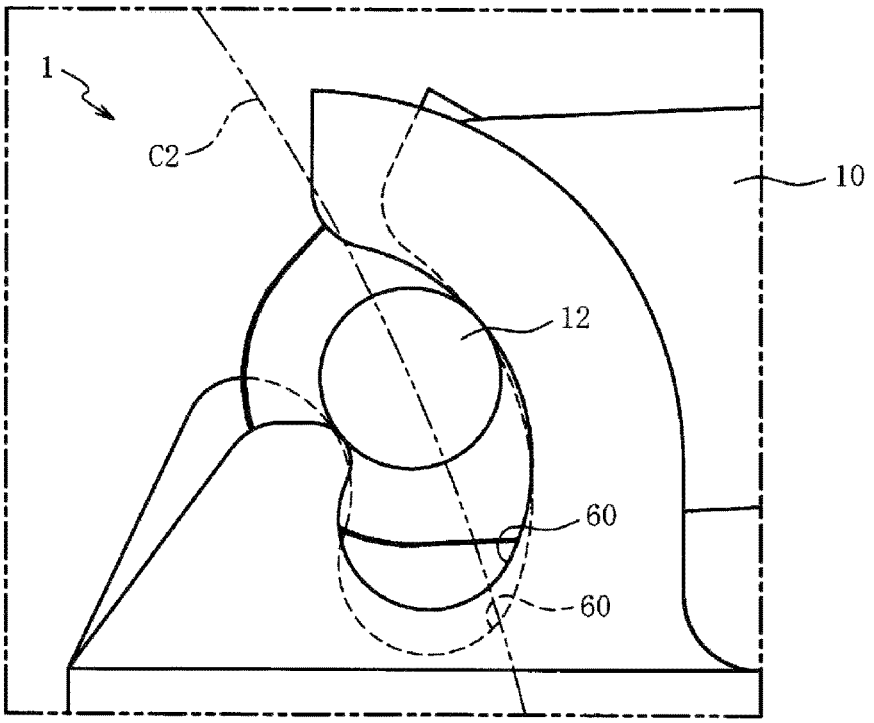

Next, the detailed configuration of the keyboard device 1 will be described with reference to FIGS. 2 to 4. FIG. 2 is a cross-sectional view of the keyboard device 1 taken along the line II-II in (a) of FIG. 1. FIG. 3 is a cross-sectional view of the keyboard device 1 showing a state in which the white key 10 is pressed from the state of FIG. 2. In FIG. 4, (a) is a partially enlarged cross-sectional view of the keyboard device 1 in which the IVa part of FIG. 3 is enlarged, and (b) is a partially enlarged cross-sectional view of the keyboard device 1 in which the IVb part of FIG. 2 is enlarged.

In addition, in FIGS. 2 to 4, in order to simplify the drawings, the illustration of a part of the keyboard device 1 is omitted, and the hatching of a part of the cross section is omitted. Further, in (a) of FIG. 4, the white key 10 in the initial state before key pressing (hereinafter the description is abbreviated as the "initial state") is shown by a broken line, and the white key 10 during the key pressing is shown by a one-dot chain line.

Further, in the following description, the configuration of the white key 10 will be mainly described, but the configuration in which a hammer 4 is rotated in conjunction with the key pressing or key releasing of the black key 20, and the configuration in which the displacement of the black key 20 is guided by the rotation of the hammer 4 or the sliding of the guiding pin 21 (see (b) of FIG. 1) are substantially the same as those of the white key 10. Therefore, the actions and effects of the configurations of the white key 10 described below are similarly exhibited in the black key 20.

As shown in FIGS. 2 and 3, the hammer 4 is rotatably connected to the central base 51 around a shaft 40 along the left-right direction (arrow L-R direction). The hammer 4 includes a mass part 41 for giving a feeling when the white key 10 is pressed, and a pressing part 42 for pressing a switch S when the white key 10 is pressed.

In the hammer 4, the part on the rear side (arrow B side) of the shaft 40 is the mass part 41, and the part on the front side (arrow F side) of the shaft 40 is the pressing part 42. A shaft 43 in a columnar shape extending in the left-right direction is formed in the pressing part 42, and a connecting part 13 rotatably connected to the shaft 43 is formed to protrude downward from the lower surface of the white key 10.

Therefore, when the white key 10 is pressed (see FIG. 3), the shaft 43 is pushed downward by the connecting part 13 of the white key 10, whereby the hammer 4 rotates around the shaft 40, and the rotation of the hammer 4 causes the mass part 41 to be displaced to be lifted. Since the mass part 41 has a weight sufficient to give the feeling of key pressing, the reaction force accompanying the rotation of the hammer 4 gives the player the feeling of pressing the white key 10.

In addition, when the white key 10 is pressed, the pressing part 42 is displaced downward, and since a substrate 7 having the switch S on the upper surface is provided below the pressing part 42, when the white key 10 is pressed, the switch S is pushed by the pressing part 42. The key pressing information (note information) of the white key 10 is detected by the on/off operation of the switch S, and a musical note signal based on the detection result is output to the outside. Although the substrate 7 is fixed to cross the central base 51 and the front base 52, it may be configured that the substrate 7 is supported by the chassis 5.

The state in which the switch S is pushed by the pressing part 42 (the state shown in FIG. 3) is the end position of the key pressing of the white key 10, and the displacement of the part of the white key 10 on the front end side (front side with respect to the center in the front-rear direction of the white key 10) to the end position of the key pressing is guided by the rotation of the connecting part 13 around the shaft 40. Since the connecting part 13 is rotatably connected to the shaft 43 located on the front side (arrow F side) of the shaft 40 of the hammer 4, the front end side of the white key 10 can be rotated along a displacement trajectory in an arc shape convex to the front side.

The guiding pin 12 extending in the left-right direction (in the width direction of the white key 10) is formed at a part on the rear end side of the white key 10, and the guiding pin 12 is slidably inserted into the guiding groove 60 extending in the up-down direction. Therefore, the guiding pin 12 can be slid downward along the guiding groove 60 to follow the downward displacement (rotation of the hammer 4) on the front end side of the white key 10. As a result, the displacement on the rear end side of the white key 10 can be guided by the sliding of the guiding pin 12 in the guiding groove 60.

As described above, in this embodiment, the displacement on the front end side of the white key 10 is guided by the rotation of the hammer 4 with respect to the chassis 5 (central base 51), and the displacement on the rear end side of the white key 10 is guided by the sliding of the guiding pin 12 with respect to the guiding groove 60. This can eliminate the need for links to guide the displacement on the rear end side of the white key 10, thus allowing the number of parts to be reduced.

Further, the hammer 4 has the mass part 41 on the side opposite to the shaft 43 with the shaft 40 interposed therebetween, and the displacement on the front end side of the white key 10 is guided by the rotation of the hammer 4; therefore, the hammer 4 can have both a function as a link for guiding the displacement of the white key 10 and a function for giving a feeling of key pressing. Since the distance from the shaft 40 of the hammer 4 to the center of gravity G of the hammer 4 is set to be greater than the distance from the shaft 40 to the shaft 43, the moment of the center of gravity G around the shaft 40 can be increased. As a result, the hammer 4 can give the player a feeling of key pressing associated with the rotation of the hammer 4 while reducing the size (weight) of the hammer 4.

Here, the center of rotation of the key of the acoustic piano is disposed at a position relatively distant from the upper surface of the key (the area where the key can be pressed) to the rear lower side; however, in the following description, the center of rotation will be defined as a reference point P.

The reference point P in the white key 10 (black key 20) is a point located on the rear lower side of the guiding pin 12 in the side view of the white key 10, and is a point located at a position where the distance from the front end of the upper surface of the white key 10 in the initial state is 200 mm or more and 500 mm or less to the rear side in the horizontal direction and 0 mm or more and 100 mm or less to the lower side in the vertical direction.

When the key of the acoustic piano rotates around the reference point P at the time of key pressing, the displacement trajectory is such that the entire key slides forward in addition to being displaced to sink downward. That is, in the key pressed state in which the key is pressed to the end position of the key pressing (hereinafter the description is abbreviated as the "key pressed state"), the entire key is disposed on the front lower side as compared with the initial state.

In this regard, in this embodiment, the guiding groove 60 is formed in a way in which the end position (see FIG. 3) of the sliding of the guiding pin 12 is located on the front lower side of the initial position (see FIG. 2) of the sliding of the guiding pin 12 with respect to the guiding groove 60. As a result, the rear end part of the white key 10 can be displaced to the front lower side by the sliding of the guiding pin 12 along the guiding groove 60 at the time of key pressing; therefore, the entire white key 10 can be disposed on the front lower side as compared with the initial state. Therefore, the posture (disposition) of the white key 10 in the key pressed state can be approximated to that of the key of the acoustic piano.

Further, when the key of the acoustic piano rotates around the reference point P at the time of key pressing, the stroke of the rear end (the amount of downward displacement from the initial state to the key pressed state) in the key-pressable area on the upper surface of the key is about ½ of the stroke of the front end of the key. Therefore, in this embodiment, the guiding groove 60 is formed in a way in which the stroke (for example, 5 mm) at the rear end in the key-pressable area (area exposed from the panel of FIG. 1) on the upper surface of the white key 10 is 45% or more and 55% or less of the stroke (for example, 10 mm) at the front end of the key-pressable area. In this way, the stroke of the white key 10 at the time of key pressing can be approximated to that of the key of the acoustic piano.

As described above, in the acoustic piano, the entire key rotates around the reference point P; therefore, in order to achieve the closest approximation to the displacement trajectory of the key, it is desirable to rotate the entire white key 10 around the reference point P.

That is, when a virtual circle C1 is drawn which is a virtual circle centered on the reference point P and which passes through the shaft 43 in the side view of the white key 10, it is preferable that the shaft 43 is rotated along the virtual circle C1. Further, when a virtual circle C2 is drawn which is a virtual circle centered on the reference point P and which passes through the center (axis) of the guiding pin 12 in the side view of the white key 10, it is preferable that the guiding pin 12 is slid along the virtual circle C2 (the guiding groove 60 is formed along the virtual circle C2). However, in order to rotate the shaft 43 along the virtual circle C1, it is necessary to dispose the shaft 40 of the hammer 4 on the reference point P, which causes the hammer 4 to be large.

Therefore, in this embodiment, the shaft 40 of the hammer 4 is disposed on the front side (arrow F side) of the guiding pin 12 to reduce the size of the hammer 4, but in this case, the shaft 43 is displaced outside the ideal virtual circle C1. In this regard, in this embodiment, since the guiding groove 60 is formed in a curved shape that is convex in the direction away from the reference point P, even when the size of the hammer 4 is reduced, the stroke (downward displacement amount) of the entire white key 10 during the key pressing can be approximated to that of the key of the acoustic piano.

Specifically, by disposing the shaft 40 of the hammer 4 in front of the guiding pin 12 and setting the radius of gyration of the shaft 43 with respect to the shaft 40 to be less than the radius of curvature of the virtual circle C1, as described above, the size of the hammer 4 can be reduced. In addition, the displacement trajectory of the shaft 43 becomes one that goes around the outside (front side) of the virtual circle C1, but as shown in (a) of FIG. 4, the guiding groove 60 is formed in a shape that curves more strongly than the virtual circle C2; therefore, the guiding pin 12 can be similarly displaced to go around the outside of the virtual circle C2.

That is, while the displacement trajectory of the shaft 43 during the key pressing deviates to the outside of the virtual circle C1, the guiding pin 12 can be displaced to the outside of the virtual circle C2 to follow the deviation. As a result, the ratio of the stroke on the rear end side to the stroke on the front end side of the white key 10 can be easily kept constant from the initial state to the key pressed state. Therefore, the stroke of the entire white key 10 (the posture of the white key 10) during the key pressing can be approximated to that of the key of the acoustic piano.

Then, the position of the shaft 40 is set so that the center (axial center) of the shaft 43 is located on the virtual circle C1 in each of the initial state and the key pressed state (see FIGS. 2 and 3), and the shape of the guiding groove 60 is set so that the center (axial center) of the guiding pin 12 is located on the virtual circle C2 in each of the initial state and the key pressed state (see FIG. 4). Therefore, the posture of the white key 10 in the initial state and the key pressed state can be approximated to that of the key of the acoustic piano.

As described above, according to this embodiment, even when the size of the hammer 4 is reduced, the stroke of the entire white key 10 during the key pressing and the posture of the key in the key pressed state can be approximated to those of the key of the acoustic piano. Therefore, it is possible to provide a playing feeling close to that of the acoustic piano.

The "shape in which the guiding groove 60 is curved more strongly than the virtual circle C2" means that, for example, when the guiding groove 60 is formed from a single arc, the radius of curvature of the guiding groove 60 is set to be less than the radius of curvature of the virtual circle C2 (i.e. the curvature of the guiding groove 60 is larger than that of the virtual circle C2). That is, it is a shape in which the part of the white key 10 (the axial center of the guiding pin 12) located on the virtual circle C2 in the initial state rotates around the outside of the virtual circle C2 during the key pressing, and is located on the virtual circle C2 again in the key pressed state.

Here, for example, if the guiding pin 12 is configured to come into contact with the inner wall surface of the terminal end of the guiding groove 60 at the end position of the sliding of the guiding pin 12, abnormal noise may be generated due to the contact. Therefore, in this embodiment, the guiding groove 60 is formed sufficiently long so that a gap is formed between the terminal end (lower end) of the guiding groove 60 and the guiding pin 12 at the end position of the sliding of the guiding pin 12. As a result, it is possible to suppress the generation of abnormal noise due to the contact between the inner wall surface at the terminal end of the guiding groove 60 and the guiding pin 12.

Further, as shown in FIG. 3, it is configured that the guiding member 6 is provided with a cushioning material 8 at a position facing the lower surface of the white key 10, and the cushioning material 8 comes into contact with the white key 10 at the end position of the sliding of the guiding pin 12. As a result, even if a gap is formed between the terminal end of the guiding groove 60 and the guiding pin 12 at the end position of the sliding of the guiding pin 12, the downward displacement on the rear end side of the white key 10 (excessive sliding of the guiding pin 12) can be regulated by the cushioning material 8. Since the cushioning material 8 is formed by using a material such as felt or urethane foam, which is more flexible than the white key 10, it is possible to suppress the generation of abnormal noise while regulating the downward displacement on the rear end side of the white key 10 by the contact between the white key 10 and the cushioning material 8.

Further, the guiding groove 60 includes an opening 60*a* that opens on the rear surface side of the guiding member 6, and the guiding pin 12 can be inserted and removed with respect to the guiding groove 60 from the opening part 60*a* (insertion and removal in the direction perpendicular to the axis of the guiding pin 12). As a result, the rear end side of the white key 10 can be attached to and detached from the guiding member 6; therefore, maintenance of the white key 10 can be facilitated. Further, since the opening 60*a* is formed on the start end side of the sliding of the guiding pin 12, it is possible to suppress the generation of abnormal noise due to the contact between the inner wall surface of the guiding groove 60 and the guiding pin 12 at the time of key releasing.

Further, the connecting part 13 is provided with a shaft hole 13*a* into which the shaft 43 is rotatably fitted, and the shaft hole 13*a* includes an opening 13*b* that opens on the lower surface of the connecting part 13. As a result, the shaft 43 can be inserted and removed from the opening 13*b* (insertion and removal in the direction perpendicular to the axis of the shaft 43); therefore, the front end side of the white key 10 can be attached to and detached from the shaft 43. That is, since the entire white key 10 can be attached to and detached from the guiding groove 60 and the shaft 43, the maintenance of the white key 10 can be further facilitated.

As described above, in this embodiment, the displacement of the white key 10 is guided by the rotation of the hammer 4 and the sliding of the guiding pin 12 in the guiding groove 60. However, the insertion position of the guiding pin 12 with respect to the guiding groove 60 may deviate from the desired position in the initial state, for example, due to variations in the dimensions of each member (for example, the total length of the white key 10) or assembly errors. Therefore, in this embodiment, it is configured that the disposition of the guiding groove 60 in the front-rear direction can be adjusted.

Specifically, the chassis 5 is provided with a pair of front and rear through holes 5*a* extending in the up-down direction, and the rear base 50 is screwed into the through holes 5*a* by screws 5*b* inserted from the lower surface side of the chassis 5. The through hole 5*a* is formed as a long hole whose length in the front-rear direction is longer than the shaft part of the screw 5*b*. Therefore, it is configured that by adjusting the insertion position of the screw 5*b* with respect to the through hole 5*a*, the disposition of the rear base 50 and the guiding member 6 with respect to the chassis 5 in the front-rear direction, that is, the disposition of the guiding groove 60 in the front-rear direction can be adjusted. Therefore, the insertion position of the guiding pin 12 with respect to the guiding groove 60 can always be adjusted to a desired position even when the dimensional variation or the assembly error occurs in each member.

Here, since the rotation center of the black key of the acoustic piano is located on the rear side (arrow B side) with respect to the rotation center of the white key (reference point P), the stroke on the rear end side of the black key to the end position of the key pressing becomes greater than the stroke on the rear end side of the white key. In this regard, in this embodiment, as shown in (b) of FIG. 4, the guiding groove 60 (shown by the broken line in (b) of FIG. 4) in which the displacement of the black key 20 is guided has a gentle curved shape (close to the virtual circle C2) that is gentler than the guiding groove 60 (shown by the solid line in (b) of FIG. 4) in which the displacement of the white key 10 is guided.

As a result, the stroke on the rear end side of the black key 20 when the guiding pins 12 and 22 slide to the end position can be made greater than that of the white key 10; therefore, a playing feeling similar to that of an acoustic piano can be provided. The "gentle curved shape (close to the virtual circle C2)" means that, for example, when the guiding groove 60 is formed from a single arc, the radius of curvature of the guiding groove 60 is large.

Next, the second to fourth embodiments will be described with reference to FIGS. 5 to 7. In the second to fourth embodiments described below, the configurations of the white keys 10, 310 and 410 will be mainly described, but the actions and effects of such configurations are similarly exhibited in the black key 20 (See FIG. 1).

First, a keyboard device 201 of the second embodiment will be described with reference to FIG. 5. In the first embodiment, the case where the guiding groove 60 is formed in a curved shape convex to the front upper side of the key 2 has been described. In contrast, in the second embodiment, the case where a guiding groove 260 is formed in a linear shape will be described. The same parts as those in the first embodiment described above are designated by the same reference numerals, and the description thereof will be omitted.

Figure 5:
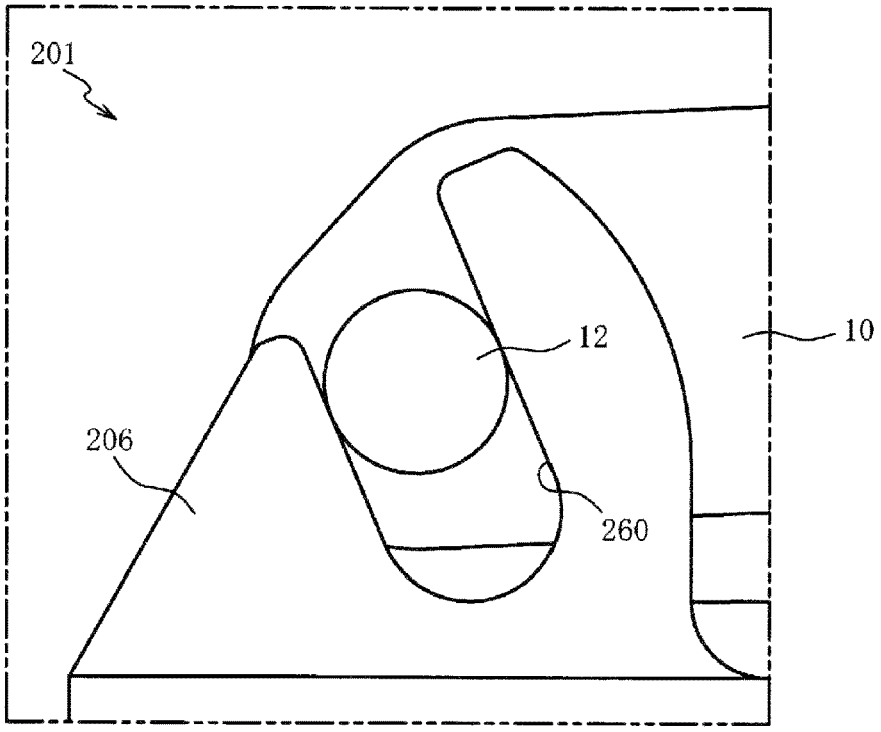
In FIG. 5, (a) is a partially enlarged cross-sectional view of the keyboard device according to the second embodiment, and (b) is a partially enlarged cross-sectional view of the keyboard device showing a state in which the white key is pressed from the state of (a) of FIG. 5.
Figure 5:
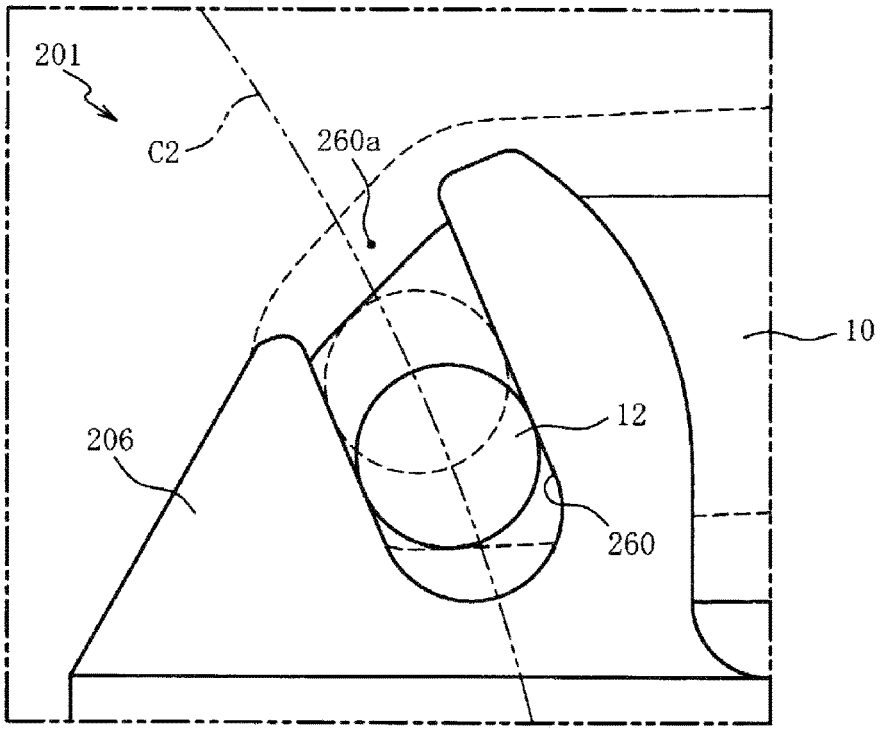

In FIG. 5, (a) is a partially enlarged cross-sectional view of the keyboard device 201 according to the second embodiment, and (b) is a partially enlarged cross-sectional view of the keyboard device 201 showing a state in which the white key 10 is pressed from the state of (a) of FIG. 5. In (b) of FIG. 5, the white key 10 in the initial state is shown by a broken line. Further, FIG. 5 shows a cross section taken at a position corresponding to FIG. 2, but hatching is omitted for simplification of the drawing, and the same applies to FIGS. 6 and 7 described later.

As shown in (a) of FIG. 5, the guiding member 206 of the keyboard device 201 includes a guiding groove 260 in a linear shape that inclines downward to the front side (right side in (a) of FIG. 5). The guiding groove 260 is a groove formed to pass through the guiding member 206 in the left-right direction (the direction perpendicular to the paper surface in (a) of FIG. 5). The groove width of the guiding groove 260 is formed to be equal to or slightly less than the diameter of the guiding pin 12 of the white key 10, and the guiding pin 12 is slidably inserted into the guiding groove 260. Therefore, the displacement on the rear end side of the white key 10 is guided by the sliding of the guiding pin 12 along the guiding groove 260. This can eliminate the need for links to guide the displacement on the rear end side of the white key 10, thus allowing the number of parts to be reduced.

Here, a case where the white key 10 is pressed is described with reference to (b) of FIG. 5, while the displacement on the front end side of the white key 10 is guided by the rotation of the hammer 4 as in the first embodiment described above (see FIGS. 2 and 3).

As shown in (b) of FIG. 5, since the guiding groove 260 is formed in a linear shape that inclines downward to the front side, the rear end part of the white key 10 can be displaced to the front lower side by the sliding of the guiding pin 12 at the time of key pressing. Therefore, since the entire white key 10 can be disposed on the front lower side as compared with the initial state, the posture (disposition) of the white key 10 in the key pressed state can be approximated to that of the key of the acoustic piano.

Further, since the guiding groove 260 is formed in a linear shape, compared with the case where the guiding groove 60 is formed in a curved shape as in the first embodiment, it is possible to suppress the occurrence of variation in the shape of the guiding groove 260 provided for each white key 10. Therefore, the stroke on the rear end side of each white key 10 can be made uniform.

The shape of the guiding groove 260 is set so that the center of the guiding pin 12 is located on the virtual circle C2 in each of the initial state and the key pressed state. Therefore, the posture of the white key 10 in the initial state and the key pressed state can be approximated to that of the key of the acoustic piano.

In the key pressed state, since a gap is formed between the terminal end (lower end) of the guiding groove 260 and the guiding pin 12, it is possible to suppress the generation of abnormal noise due to the contact between the inner wall surface of the guiding groove 260 and the guiding pin 12. Further, since the guiding member 206 is provided with the cushioning material 8 (see FIGS. 2 and 3) at a position facing the lower surface of the white key 10, even when a gap is formed between the terminal end of the guiding groove 260 and the guiding pin 12 in the key pressed state, the downward displacement on the rear end side of the white key 10 can be regulated by the cushioning material 8.

Further, the guiding groove 60 includes an opening 260*a* that opens on the rear surface side of the guiding member 206, and the guiding pin 12 can be inserted and removed from the opening 260*a*. As a result, maintenance of the white key 10 can be facilitated. Further, since the opening 260*a* is formed on the start end side of the sliding of the guiding pin 12, it is possible to suppress the generation of abnormal noise due to the contact between the inner wall surface of the guiding groove 260 and the guiding pin 12 at the time of key releasing.

Next, a keyboard device 301 of the third embodiment will be described with reference to FIG. 6. In the first and second embodiments, the case has been described in which the guiding pin 12 is formed on the white key 10, and the guiding grooves 60 and 260 are formed in the guiding members 6 and 206. In contrast, in the third embodiment, a case will be described in which a guiding pin 361 is formed on a guiding member 306, and a guiding groove 314 is formed in the white key 310. The same parts as those in the first and second embodiments described above are designated by the same reference numerals, and the description thereof will be omitted.

Figure 6:
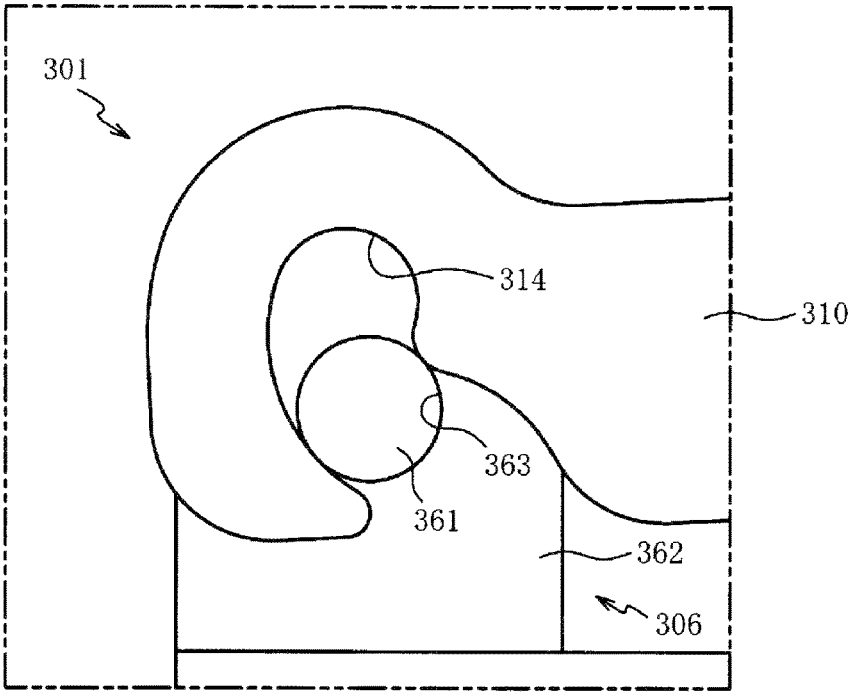
In FIG. 6, (a) is a partially enlarged cross-sectional view of a keyboard device according to the third embodiment, and (b) is a partially enlarged cross-sectional view of the keyboard device showing a state in which the white key is pressed from the state of (a) of FIG. 6.
Figure 6:
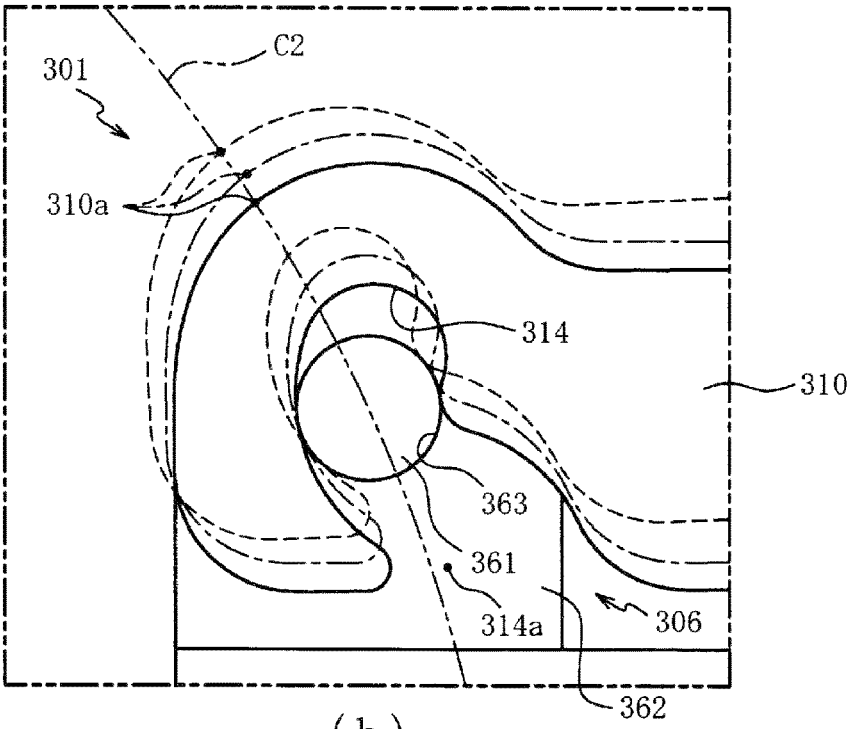

In FIG. 6, (a) is a partially enlarged cross-sectional view of the keyboard device 301 according to the third embodiment, and (b) is a partially enlarged cross-sectional view of the keyboard device 301 showing a state in which the white key 310 is pressed from the state of (a) of FIG. 6. Further, in (b) of FIG. 6, the white key 310 in the initial state is shown by a broken line, and the white key 310 during the key pressing is shown by a one-dot chain line.

As shown in (a) of FIG. 6, the guiding member 306 of the keyboard device 301 includes an insertion part 362 for inserting the guiding pin 361 in a columnar shape. The insertion part 362 is a plate-shaped body extending in the up-down direction, and the insertion part 362 is provided with a through hole 363 penetrating in the left-right direction (in the direction perpendicular to the paper surface of (a) of FIG. 6). Though not shown, a pair of insertion parts 362 are formed on the guiding member 306 spaced apart for predetermined distance in the left-right direction, and the guiding pin 361 is fixed in a state of being inserted into the through hole 363 of the pair of insertion parts 362.

The white key 310 includes a guiding groove 314 extending upward from the lower surface thereof. The guiding groove 314 is a groove formed to pass through the white key 310 in the left-right direction. The groove width of the guiding groove 314 is formed to be equal to or slightly less than the diameter of the guiding pin 361, and the guiding pin 361 is slidably inserted into the guiding groove 314. Therefore, when the white key 310 is pressed, the guiding groove 314 slides downward along the guiding pin 361, whereby the downward displacement on the rear end side of the white key 310 is guided. This can eliminate the need for links to guide the displacement on the rear end side of the white key 310, thus allowing the number of parts to be reduced.

Further, though not shown, one guiding pin 361 is fixed across multiple guiding members 306 (for one octave in this embodiment) disposed side by side in the left-right direction. That is, since the common guiding pin 361 is inserted in each of the guiding grooves 314 of the multiple white keys 310 (black keys), the displacement on the rear end side of the multiple white keys 310 can be guided by one guiding pin 361. Therefore, the number of parts can be reduced.

Here, a case where the white key 310 is pressed is described with reference to (b) of FIG. 6, while the displacement on the front end side of the white key 310 is guided by the rotation of the hammer 4 as in the first embodiment described above (see FIGS. 2 and 3).

As shown in (b) of FIG. 6, the guiding groove 314 is formed in a way in which the end position is located on the rear upper side of the white key 310 with respect to the initial position of the sliding of the guiding pin 361 with respect to the guiding groove 314. As a result, the rear end part of the white key 310 can be displaced to the front lower side by the sliding of the guiding groove 314 along the guiding pin 361 at the time of key pressing; therefore, the entire white key 310 can be disposed on the front lower side as compared with the initial state. Therefore, the posture (disposition) of the white key 310 in the key pressed state can be approximated to that of the key of the acoustic piano.

Further, also in this embodiment as in the first embodiment, the shaft 40 of the hammer 4 is disposed on the front side of the guiding pin 361; therefore, the shaft 43 is displaced outside the ideal virtual circle C1 during the key pressing (see FIGS. 2 and 3). In this regard, in this embodiment, since the guiding groove 314 is formed in a curved shape that is convex in the direction approaching the reference point P (see FIGS. 2 and 3), even when the shaft 40 of the hammer 4 is disposed on the front side of the guiding pin 361, the stroke of the entire white key 310 during the key pressing can be approximated to that of the key of the acoustic piano.

Specifically, as in the first embodiment described above, by disposing the shaft 40 of the hammer 4 on the front side of the guiding pin 361, the size of the hammer 4 can be reduced. In addition, the displacement trajectory of the shaft 43 becomes a displacement trajectory that goes around the outside of the virtual circle C1 (see FIGS. 2 and 3), but as shown in (b) of FIG. 6, the guiding groove 314 is formed in a curved shape that is convex toward the inside of the virtual circle C2. As a result, a part 310*a* of the white key 310 located on the virtual circle C2 in the initial state can be displaced outside the virtual circle C2 during the key pressing.

That is, while the displacement trajectory of the shaft 43 during the key pressing deviates to the outside of the virtual circle C1, the rear end side of the white key 310 can be displaced to follow the deviation. As a result, the ratio of the stroke on the rear end side to the stroke on the front end side of the white key 310 can be easily kept constant from the initial state to the key pressed state. Therefore, the stroke of the entire white key 310 during the key pressing can be approximated to that of the key of the acoustic piano.

Further, since the shape of the guiding groove 314 is set in a way in which the part 310*a* of the white key 310 located on the virtual circle C2 in the initial state is located on the virtual circle C2 in the key pressed state as well, the posture of the white key 310 in the initial state and the key pressed state can be approximated to that of the key of the acoustic piano. Therefore, it is possible to provide a playing feeling close to that of the acoustic piano.

In the key pressed state, since a gap is formed between the terminal end (upper end) of the guiding groove 314 and the guiding pin 361, it is possible to suppress the generation of abnormal noise due to the contact between the inner wall surface of the guiding groove 314 and the guiding pin 361. Further, since the guiding member 306 is provided with the cushioning material 8 (see FIGS. 2 and 3) at a position facing the lower surface of the white key 310, even when a gap is formed between the terminal end of the guiding groove 314 and the guiding pin 361 in the key pressed state, the downward displacement on the rear end side of the white key 310 can be regulated by the cushioning material 8.

Further, the guiding groove 314 includes an opening 314*a* that opens on the lower surface side of the white key 310, and the guiding pin 361 can be inserted and removed from the opening 314*a*. As a result, maintenance of the white key 310 can be facilitated. Further, since the opening 314*a* is formed on the start end side of the sliding of the guiding pin 361, it is possible to suppress the generation of abnormal noise due to the contact between the inner wall surface of the guiding groove 314 and the guiding pin 361 at the time of key releasing.

Further, though not shown, the guiding groove of the black key has a gentler curved shape than the guiding groove 314 of the white key 310, as in the first embodiment. That is, for the strokes of the white key 310 and the black key when the guiding pin 361 slides to the terminal position, the stroke of the black key is set to be greater than that of the white key 310. Therefore, it is possible to provide a playing feeling close to that of the acoustic piano.

Next, a keyboard device 401 of the fourth embodiment will be described with reference to FIG. 7. In the third embodiment, the case where the guiding groove 314 is formed in a curved shape convex to the rear lower side of the key 2 has been described. In contrast, in the fourth embodiment, the case where a guiding groove 414 is formed in a linear shape will be described. The same parts as those in the third embodiment described above are designated by the same reference numerals, and the description thereof will be omitted.

Figure 7:
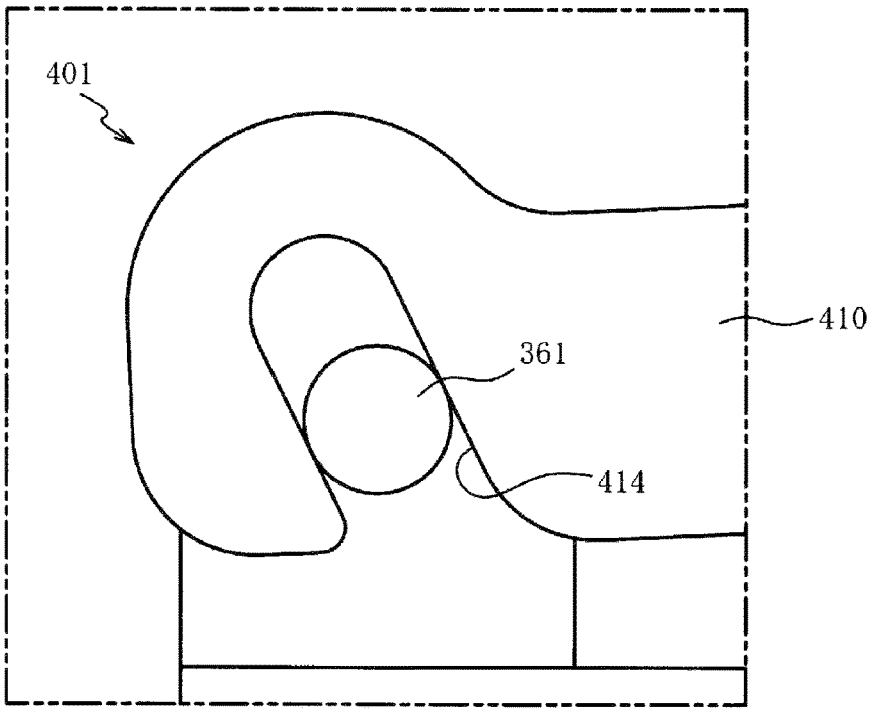
In FIG. 7, (a) is a partially enlarged cross-sectional view of a keyboard device according to the fourth embodiment, and (b) is a partially enlarged cross-sectional view of the keyboard device showing a state in which the white key is pressed from the state of (a) of FIG. 7.
Figure 7:
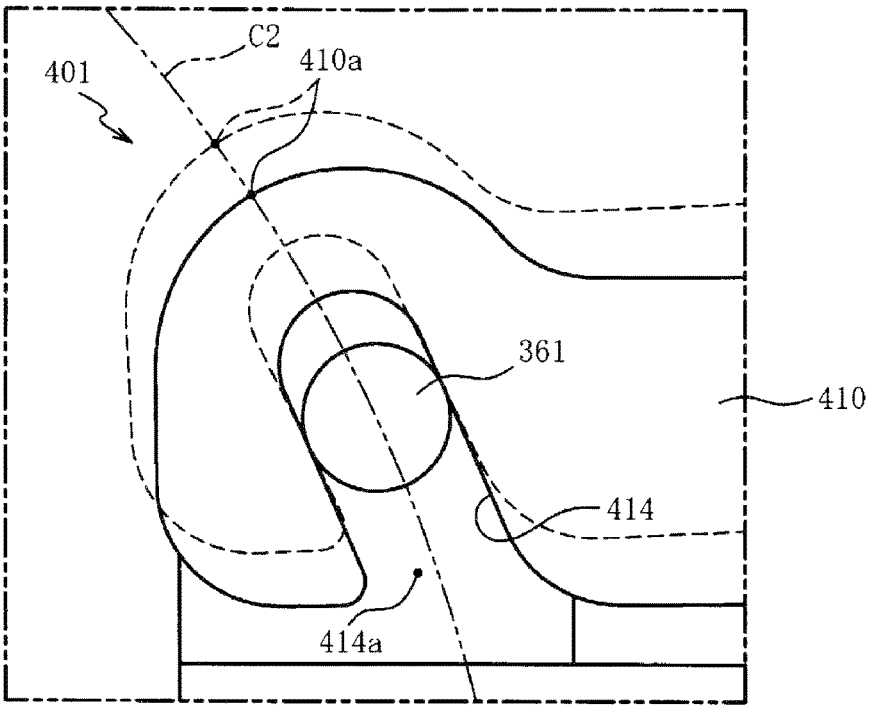

In FIG. 7, (a) is a partially enlarged cross-sectional view of the keyboard device 401 according to the fourth embodiment, and (b) is a partially enlarged cross-sectional view of the keyboard device 401 showing a state in which the white key 410 is pressed from the state of (a) of FIG. 7. In (b) of FIG. 7, the white key 410 in the initial state is shown by a broken line.

As shown in (a) of FIG. 7, the white key 410 of the keyboard device 401 includes a guiding groove 414 in a linear shape that inclines downward to the front side (right side in (a) of FIG. 7). The guiding groove 414 is a groove formed to pass through the white key 410 in the left-right direction (the direction perpendicular to the paper surface in (a) of FIG. 7). The groove width of the guiding groove 414 is formed to be equal to or slightly less than the diameter of the guiding pin 361, and the guiding pin 361 is slidably inserted into the guiding groove 414. Therefore, the displacement on the rear end side of the white key 410 is guided by the sliding of the guiding pin 361 along the guiding groove 414. This can eliminate the need for links to guide the displacement on the rear end side of the white key 410, thus allowing the number of parts to be reduced.

Here, a case where the white key 410 is pressed is described with reference to (b) of FIG. 7, while the displacement on the front end side of the white key 410 is guided by the rotation of the hammer 4 as in the first embodiment described above (see FIGS. 2 and 3).

As shown in (b) of FIG. 7, since the guiding groove 414 is formed in a linear shape that inclines downward to the front side, the rear end part of the white key 410 can be displaced to the lower front side by the sliding of the guiding pin 361 at the time of key pressing. Therefore, since the entire white key 410 can be disposed on the front lower side as compared with the initial state, the posture (disposition) of the white key 410 in the key pressed state can be approximated to that of the key of the acoustic piano.

Further, since the guiding groove 414 is formed in a linear shape, compared with the case where the guiding groove 314 is formed in a curved shape as in the third embodiment, it is possible to suppress the occurrence of variation in the shape of the guiding groove 414 provided for each white key 410.

Further, since the shape of the guiding groove 414 is set in a way in which a part 410*a* of the white key 410 located on the virtual circle C2 in the initial state is located on the virtual circle C2 in the key pressed state as well, the posture of the white key 410 in the initial state and the key pressed state can be approximated to that of the key of the acoustic piano. Therefore, it is possible to provide a playing feeling close to that of the acoustic piano.

In the key pressed state, since a gap is formed between the terminal end (upper end) of the guiding groove 414 and the guiding pin 361, it is possible to suppress the generation of abnormal noise due to the contact between the inner wall surface of the guiding groove 414 and the guiding pin 361. Further, since the guiding member 306 is provided with the cushioning material 8 (see FIGS. 2 and 3) at a position facing the lower surface of the white key 410, even when a gap is formed between the terminal end of the guiding groove 414 and the guiding pin 361 in the key pressed state, the downward displacement on the rear end side of the white key 410 can be regulated by the cushioning material 8.

Further, the guiding groove 414 includes an opening 414*a* that opens on the lower surface side of the white key 410, and the guiding pin 361 can be inserted and removed from the opening 414*a*. As a result, maintenance of the white key 410 can be facilitated. Further, since the opening 414*a* is formed on the start end side of the sliding of the guiding pin 361, it is possible to suppress the generation of abnormal noise due to the contact between the inner wall surface of the guiding groove 414 and the guiding pin 361 at the time of key releasing.

Although the disclosure has been described based on the above embodiments, the disclosure is not limited to the above embodiments, and it can be easily inferred that various improvements and modifications may be made within the scope that does not deviate from the spirit of the disclosure.

In each of the above embodiments, the case where the keyboard devices 1, 201, 301, 401 are configured as an electronic piano has been described, but the disclosure is not necessarily limited thereto. For example, the technical idea of each of the above embodiments can be applied to other electronic musical instruments (for example, electronic organs, synthesizers, accordions, and the like).

In each of the above embodiments, the case where the displacement on the front end side of the key 2 is guided by the hammer 4 for providing the feeling of key pressing (returning the key 2 to the initial position) has been described, but the disclosure is not necessarily limited thereto. For example, it may be configured that the displacement on the front end side of the key 2 is guided by a link that does not have the function of providing the feeling of key pressing (returning the key 2 to the initial position). In this case, the key 2 may be returned to the initial position by an elastic body such as a spring.

In each of the above embodiments, the case where one hammer 4 functions as a link to guide the rotation of the key 2 has been described, but the disclosure is not necessarily limited thereto. For example, it may be configured that a link for guiding the rotation of the key 2 is separately provided in addition to the hammer 4. That is, if it is configured that the displacement on the rear end side of the key 2 is guided by the guiding groove and the guiding pin, at least one link for guiding the displacement on the rear end side can be omitted.

In each of the above embodiments, the case where the shaft 40 of the hammer 4 is located on the rear side of the shaft 43 has been described, but the disclosure is not necessarily limited thereto. For example, the shaft 40 of the hammer 4 may be located on the front side of the shaft 43.

In each of the above embodiments, the case has been described in which the distance from the shaft 40 of the hammer 4 to the center of gravity G is set to be longer than the distance from the shaft 40 to the shaft 43, but the disclosure is not necessarily limited thereto. For example, the distance from the shaft 40 of the hammer 4 to the center of gravity G may be set to be equal to or shorter than the distance from the shaft 40 to the shaft 43.

In each of the above embodiments, the case where the shaft 40 of the hammer 4 is disposed on the front side of the guiding pins 12, 22 and 361 has been described, but the disclosure is not necessarily limited thereto. For example, the shaft 40 of the hammer 4 may be disposed on the rear side of the guiding pins 12, 22 and 361. As a result, the displacement trajectory on the front end side of the key 2 can be further approximated to that of the key of the acoustic piano.

In each of the above embodiments, the case where the shaft 43 is located on the virtual circle C1 in the key pressed state has been described, but the disclosure is not necessarily limited thereto. For example, the shaft 43 of the hammer 4 may be located inside or outside the virtual circle C1 in the key pressed state.

In each of the above embodiments, the case where the guiding pins 12, 22 and 361 are formed in a columnar shape (whose cross section is circular) has been described, but the disclosure is not necessarily limited thereto. For example, the cross-sectional shape of the guiding pins 12, 22 and 361 may be formed into a polygon as long as the guiding pins can 12, 22 and 361 slide along the guiding grooves 60, 314 and 414.

In each of the above embodiments, the case where the guiding pins 12, 22 and 361 are inserted into the guiding grooves 60, 314 and 414 penetrating in the left-right direction has been described, but the disclosure is not necessarily limited thereto. For example, it may be configured that the guiding grooves 60, 314 and 414 are recesses formed on the side surfaces of the guiding member 6 and the key 2, and the guiding pins are slid along the recesses.

In each of the above embodiments, the case has been described in which the guiding grooves 60, 314 and 414 are formed in a way in which the rear end part of the key 2 is displaced to the front lower side at the time of key pressing, but the disclosure is not necessarily limited thereto. For example, the guiding grooves 60, 314 and 414 may be formed in a way in which the rear end part of the key 2 is displaced to the rear lower side or the lower side.

In each of the above embodiments, the case where the openings 60*a*, 314*a* and 414*a* are formed in the guiding grooves 60, 314 and 414 has been described, but the disclosure is not necessarily limited thereto. For example, it may be configured that the openings 60*a*, 314*a* and 414*a* are omitted, and the start end side and the terminal end side of the guiding grooves 60, 314 and 414 are closed. In this case, it may be configured that the guiding pins 12, 22 and 361 come into contact with the inner wall surface of the start end or the terminal end of the guiding grooves 60, 314 and 414 at the time of key pressing or key releasing.

In each of the above embodiments, the case has been described in which the cushioning material 8 is provided on the guiding members 6, 206 and 306 to regulate the downward displacement of the key 2, but the disclosure is not necessarily limited thereto. For example, the cushioning material 8 may be provided at the terminal end of the guiding grooves 60, 314 and 414. That is, the disposition of the cushioning material 8 can be set as appropriate as long as the displacement of the key 2 can be regulated at the end position of the key pressing, but it is preferable to dispose the cushioning material 8 on the rear end side of the key 2

(near the guiding pins 12, 22 and 361) so that the displacement on the rear end side of the key 2 can be regulated at a desired position.

In each of the above embodiments, the case has been described in which the part of the key 2 located on the virtual circle C2 in the initial state is disposed on the virtual circle C2 in the key pressed state, but the disclosure is not necessarily limited thereto. For example, it may be configured that the part of the key 2 located on the virtual circle C2 in the initial state is disposed inside or outside the virtual circle C2 in the key pressed state.

In the first and third embodiments, the case has been described in which the guiding grooves 60 and 314 are formed in a curved shape to protrude inward or outward with respect to the virtual circle C2, but the disclosure is not necessarily limited thereto. For example, the guiding groove 60 may be formed in a curved shape convex in a direction approaching the reference point P, or the guiding groove 314 may be formed in a curved shape convex in a direction away from the reference point P. Further, the guiding grooves 60 and 314 may be formed in a curved shape along the virtual circle C2 (an arc shape having the same radius of curvature as the virtual circle C2).

In the first and third embodiments, the case has been described in which the guiding grooves 60 and 314 are formed in a gentle curved shape to make the stroke on the rear end side of the black key 20 greater than that of the white keys 10 and 310, but the disclosure is not necessarily limited thereto. For example, the shapes of the guiding grooves 60 and 314 may be the same for the white key and the black key so that the strokes on the rear end side of the white keys 10 and 310 and the black key 20 are the same.

In the third and fourth embodiments, the case has been described in which the common guiding pin 361 is inserted into the guiding grooves 314 and 414 of the multiple keys 2, but the disclosure is not necessarily limited thereto. For example, as in the first and second embodiments, a separate guiding pin may be provided for each key 2 (each guiding member 306).

REFERENCE SIGNS LIST

What is claimed is:

1. A keyboard device comprising:

a support member;

a link with one end side rotatably connected to the support member;

a key rotatably connected to an other end side of the link;

a guiding pin which is provided on one of a part on a rear end side of the key and a support member side and which extends in a width direction of the key; and a guiding groove which is provided on the other of the part on the rear end side of the key and the support member side and into which the guiding pin is inserted, wherein a displacement of a part on a front end side of the key is guided by rotation of the link with respect to the support member, and a displacement of the part on the rear end side of the key is guided by sliding of the guiding pin with respect to the guiding groove.

2. The keyboard device according to claim 1, wherein the part on the rear end side of the key is displaced to a front lower side by the sliding of the guiding pin with respect to the guiding groove at the time of key pressing of the key.

3. The keyboard device according to claim 2, wherein the guiding groove is formed in a linear shape that is inclined downward to the front side of the key.

4. The keyboard device according to claim 1, wherein a first rotation axis, which is a rotation axis of the link with respect to the support member, is located on a rear side of a second rotation axis, which is a rotation axis of the key with respect to the link.

5. The keyboard device according to claim 4, wherein the key is provided with the guiding pin, and with respect to a reference point located on a rear lower side of the guiding pin in a side view of the key, the guiding groove is formed in a curved shape that is convex in a direction away from the reference point.

6. The keyboard device according to claim 5, wherein in a case where a first virtual circle is drawn, which is a virtual circle centered on the reference point in the side view of the key and which passes through the second rotation axis in an initial state before the key is pressed, a distance from the first rotation axis to the second rotation axis is set to be less than a radius of curvature of the first virtual circle, and in a case where a second virtual circle is drawn, which is a virtual circle centered on the reference point in the side view of the key and which passes through the guiding pin in the initial state, the guiding groove is formed in a shape with a larger curvature than the second virtual circle.

7. The keyboard device according to claim 4, wherein the key is provided with the guiding groove, and with respect to a reference point located on a rear lower side of the guiding pin in a side view of the key, the guiding groove is formed in a curved shape that is convex in a direction approaching the reference point.

8. The keyboard device according to claim 7, wherein in a case where a first virtual circle is drawn, which is a virtual circle centered on the reference point in the side view of the key and which passes through the second rotation axis in an initial state before the key is pressed, a distance from the first rotation axis to the second rotation axis is set to be less than a radius of curvature of the first virtual circle.

9. The keyboard device according to claim 1, wherein the key comprises a white key and a black key, and for a downward displacement amount of the key when the guiding pin slides to an end position, the downward displacement amount of the black key is set to be greater than the downward displacement amount of the white key.

10. The keyboard device according to claim 4, wherein the link has a center of gravity on a side opposite to the second rotation axis with the first rotation axis interposed therebetween, and a distance from the first rotation axis to the center of gravity of the link is set to be greater than a distance from the first rotation axis to the second rotation axis.

11. The keyboard device according to claim 1, further comprising a guiding member whose fixed position with respect to the support member is configured to be variable in a front-rear direction and on which the guiding pin or the guiding groove is provided.

12. The keyboard device according to claim 1, wherein the key is provided with the guiding groove, and a displacement of rear end parts of a plurality of the keys is guided by one guiding pin.

13. The keyboard device according to claim 1, wherein the guiding groove is provided with an opening from which the guiding pin is insertable and removable with respect to the guiding groove.

14. The keyboard device according to claim 1, wherein a gap is formed between a terminal end of the guiding groove and the guiding pin at an end position of the sliding of the guiding pin.

15. The keyboard device according to claim 14, further comprising a cushioning material that regulates a displacement of the guiding pin to the terminal end of the guiding groove.

16. A keyboard device comprising:

a support member;

a link with one end side rotatably connected to the support member;

a key rotatably connected to an other end side of the link;

a guiding pin which is provided on one of a part on a rear end side of the key and a support member side and which extends in a width direction of the key; and a guiding groove which is provided on the other of the part on the rear end side of the key and the support member side and into which the guiding pin is inserted, wherein a part on a rear end side of the key is displaced to a front lower side by sliding of the guiding pin with respect to the guiding groove at the time of key pressing of the key.

17. The keyboard device according to claim 16, wherein the guiding groove is formed in a linear shape that is inclined downward to the front side of the key.

18. The keyboard device according to claim 16, wherein a first rotation axis, which is a rotation axis of the link with respect to the support member, is located on a rear side of a second rotation axis, which is a rotation axis of the key with respect to the link.

19. The keyboard device according to claim 18, wherein the key is provided with the guiding pin, and with respect to a reference point located on a rear lower side of the guiding pin in a side view of the key, the guiding groove is formed in a curved shape that is convex in a direction away from the reference point.

20. The keyboard device according to claim 19, wherein in a case where a first virtual circle is drawn, which is a virtual circle centered on the reference point in the side view of the key and which passes through the second rotation axis in an initial state before the key is pressed, a distance from the first rotation axis to the second rotation axis is set to be less than a radius of curvature of the first virtual circle, and in a case where a second virtual circle is drawn, which is a virtual circle centered on the reference point in the side view of the key and which passes through the guiding pin in the initial state, the guiding groove is formed in a shape that curves more strongly than the second virtual circle.

* * * * *